US011305559B2

(12) United States Patent
Kim et al.

(10) Patent No.: US 11,305,559 B2
(45) Date of Patent: Apr. 19, 2022

(54) FUSER WITH ENDLESS BELT SUPPORTED BY ROTATIONAL MEMBER

(71) Applicant: HEWLETT-PACKARD DEVELOPMENT COMPANY, L.P., Spring, TX (US)

(72) Inventors: Jung Tae Kim, Suwon-si (KR); Young Su Lee, Suwon-si (KR); Ki Hyuk Lee, Suwon-si (KR); Hee Gun Jo, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/978,092

(22) PCT Filed: Aug. 22, 2018

(86) PCT No.: PCT/KR2018/009630
§ 371 (c)(1),
(2) Date: Sep. 3, 2020

(87) PCT Pub. No.: WO2019/177212
PCT Pub. Date: Sep. 19, 2019

(65) Prior Publication Data

US 2021/0008898 A1 Jan. 14, 2021

(30) Foreign Application Priority Data

Mar. 15, 2018 (KR) ..... 10-2018-0030544

(51) Int. Cl.
*B41J 11/00* (2006.01)

(52) U.S. Cl.
CPC ..... *B41J 11/0024* (2021.01); *B41J 11/0022* (2021.01)

(58) Field of Classification Search
CPC ... B41J 11/002; B41J 11/0022; B41J 11/0024; B41J 11/0005; B41J 11/007
See application file for complete search history.

(56) References Cited

U.S. PATENT DOCUMENTS

| | | | |
|---|---|---|---|
| 7,317,892 | B2 | 1/2008 | Ito et al. |
| 7,460,797 | B2 | 12/2008 | Yoshikawa |
| 8,811,874 | B2 | 8/2014 | Shimokawa et al. |

(Continued)

FOREIGN PATENT DOCUMENTS

| | | |
|---|---|---|
| CN | 101101473 | 1/2008 |
| CN | 101311845 | 11/2008 |

(Continued)

*Primary Examiner* — Bradley W Thies
(74) *Attorney, Agent, or Firm* — Staas & Halsey LLP

(57) ABSTRACT

A fuser includes an endless belt; a heat source to heat the endless belt; a pressing roller to press the endless belt to form a heating nip, through which a printing medium is to pass, the pressing roller to rotate the endless belt; a pair of supporting members spaced apart from each other in an axial direction of the endless belt; and a pair of rotational members that are loosely inserted into an inner portion of the endless belt, respectively at two side end portions of the endless belt, the pair of rotational members to be rotatably supported by the pair of supporting members and rotated with the endless belt.

14 Claims, 7 Drawing Sheets

(56) References Cited

U.S. PATENT DOCUMENTS

| | | | |
|---|---|---|---|
| 9,348,275 | B2 | 5/2016 | Fukunaga et al. |
| 2005/0220509 | A1 | 10/2005 | Kubochi et al. |
| 2010/0104298 | A1 | 4/2010 | Hachisuka |
| 2013/0209124 | A1 | 8/2013 | Saito |
| 2014/0294468 | A1 | 10/2014 | Nanjo |
| 2016/0098003 | A1 | 4/2016 | Uchitani et al. |
| 2016/0320729 | A1 | 11/2016 | Park et al. |
| 2017/0050448 | A1 | 2/2017 | Jang et al. |

FOREIGN PATENT DOCUMENTS

| | | | | |
|---|---|---|---|---|
| CN | 101692161 | | 4/2010 | |
| CN | 102445885 | | 5/2012 | |
| CN | 102566379 | | 7/2012 | |
| CN | 102681411 | | 9/2012 | |
| CN | 103186086 | | 7/2013 | |
| CN | 105278274 | | 1/2016 | |
| CN | 105900021 | | 8/2016 | |
| EP | 1642739 | | 4/2006 | |
| EP | 2179855 | | 4/2010 | |
| EP | 2955580 | | 12/2015 | |
| EP | 3093715 | | 11/2016 | |
| JP | 2002357964 | | 12/2002 | |
| JP | 2002361939 | | 12/2002 | |
| JP | 2002361939 | A * | 12/2002 | |
| JP | 20100014865 | | 1/2010 | |
| JP | 2010211093 | | 9/2010 | |
| JP | 2010211093 | A * | 9/2010 | |
| JP | 5278750 | | 9/2013 | |
| JP | 2016001279 | | 1/2016 | |
| JP | 2016001279 | A * | 1/2016 | ..... B65H 29/14 |
| KR | 20150082055 | | 7/2015 | |
| KR | 20150082055 | A * | 7/2015 | ..... G03G 15/2053 |
| KR | 20160078949 | | 7/2016 | |

* cited by examiner

【Figure 1】
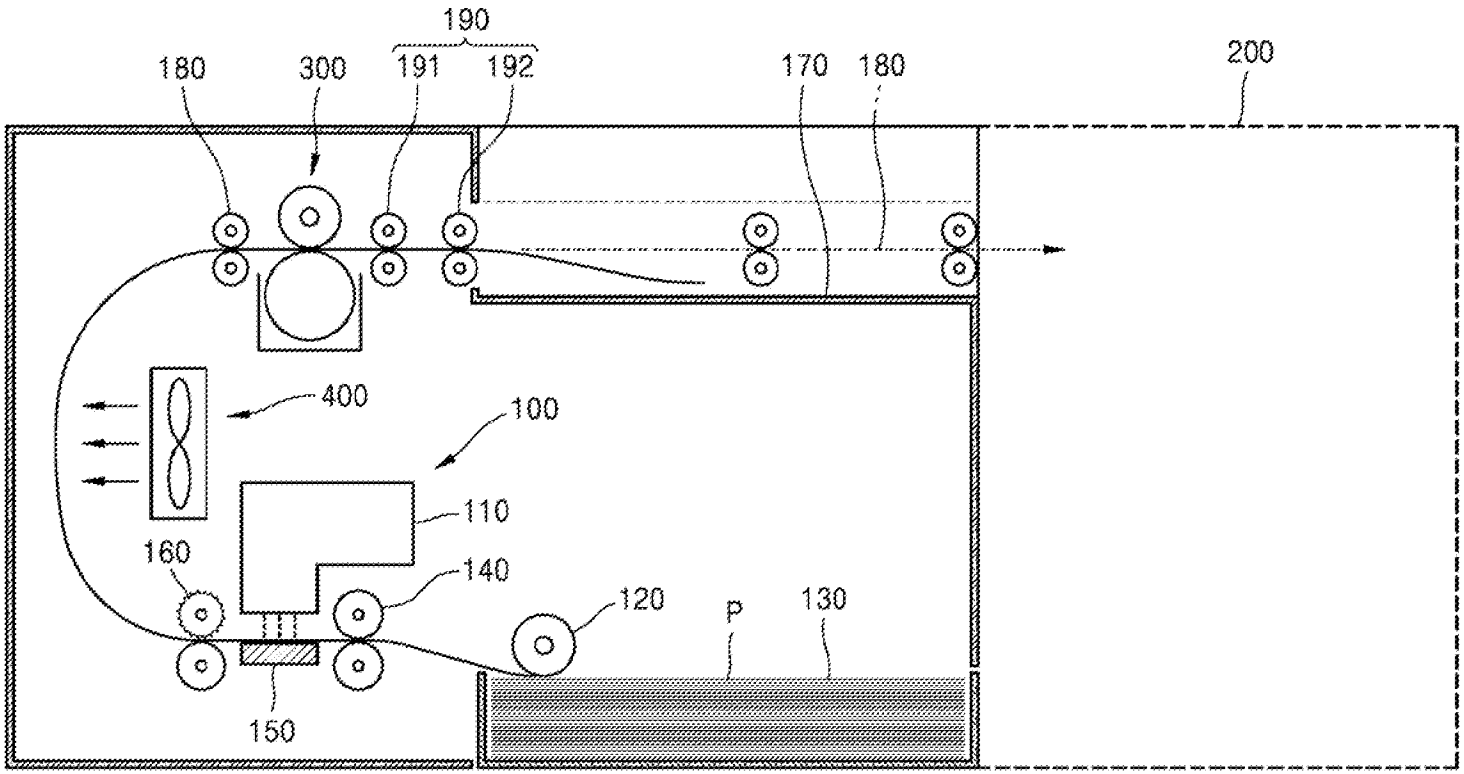

[Figure 2]
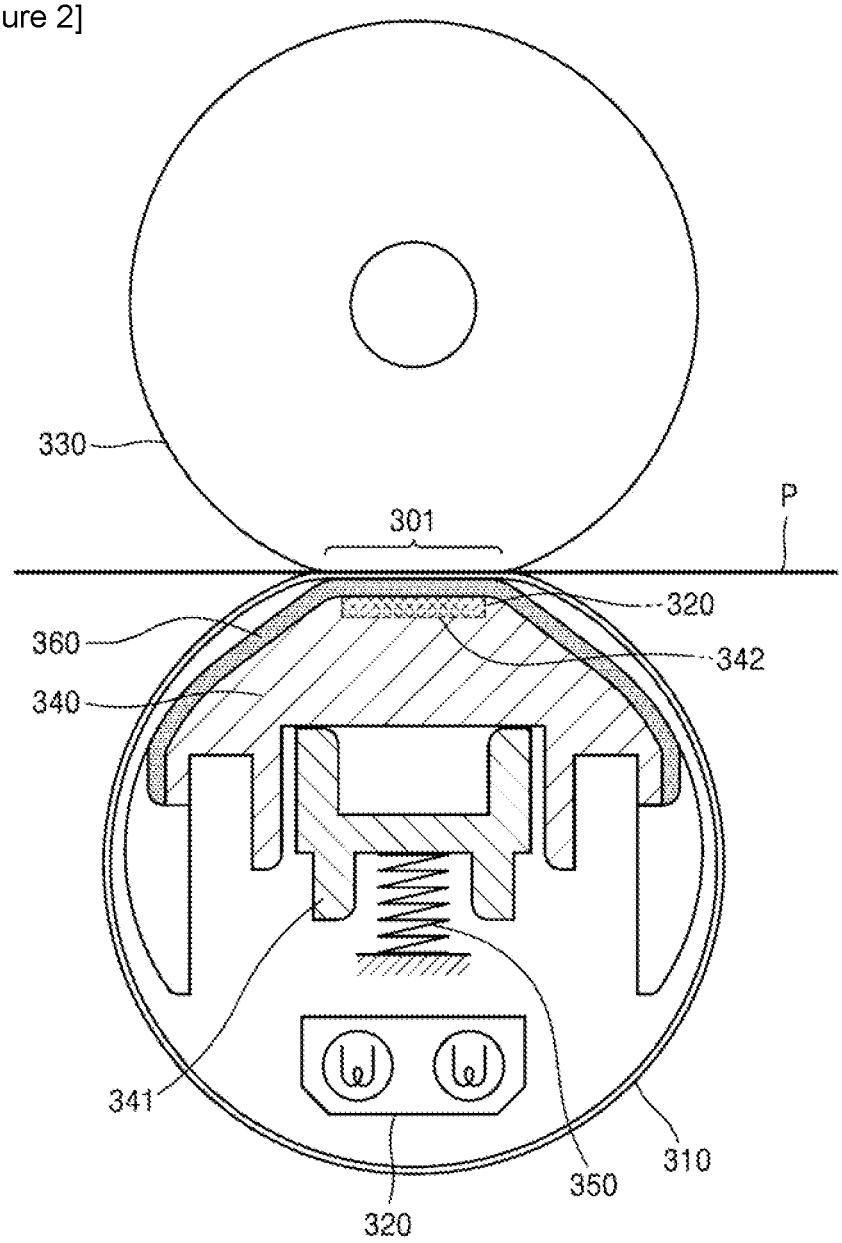

[Figure 3]
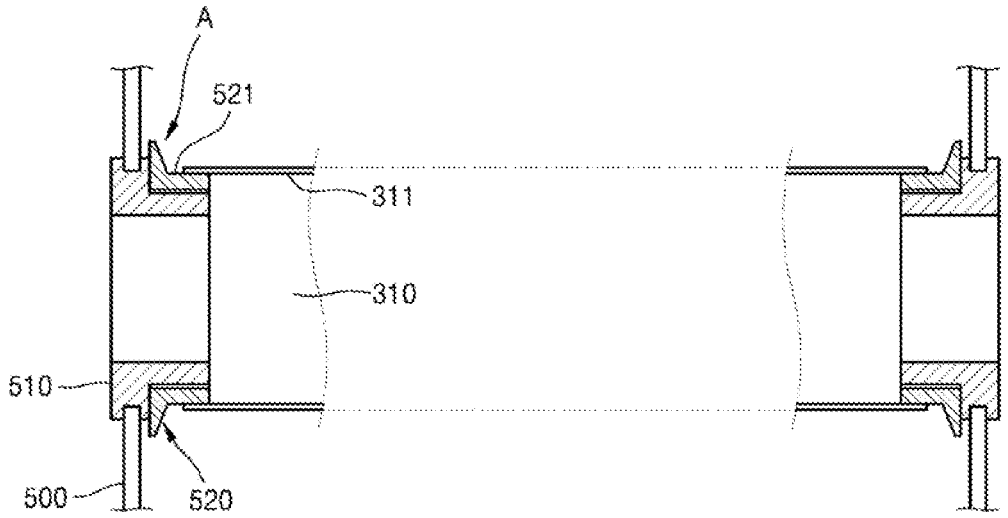
【Figure 4】
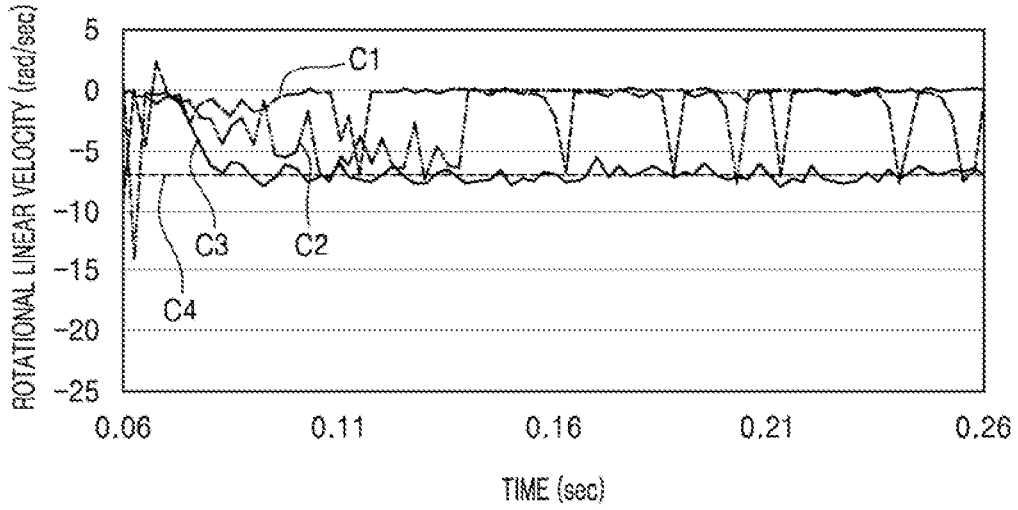

[Figure 5]
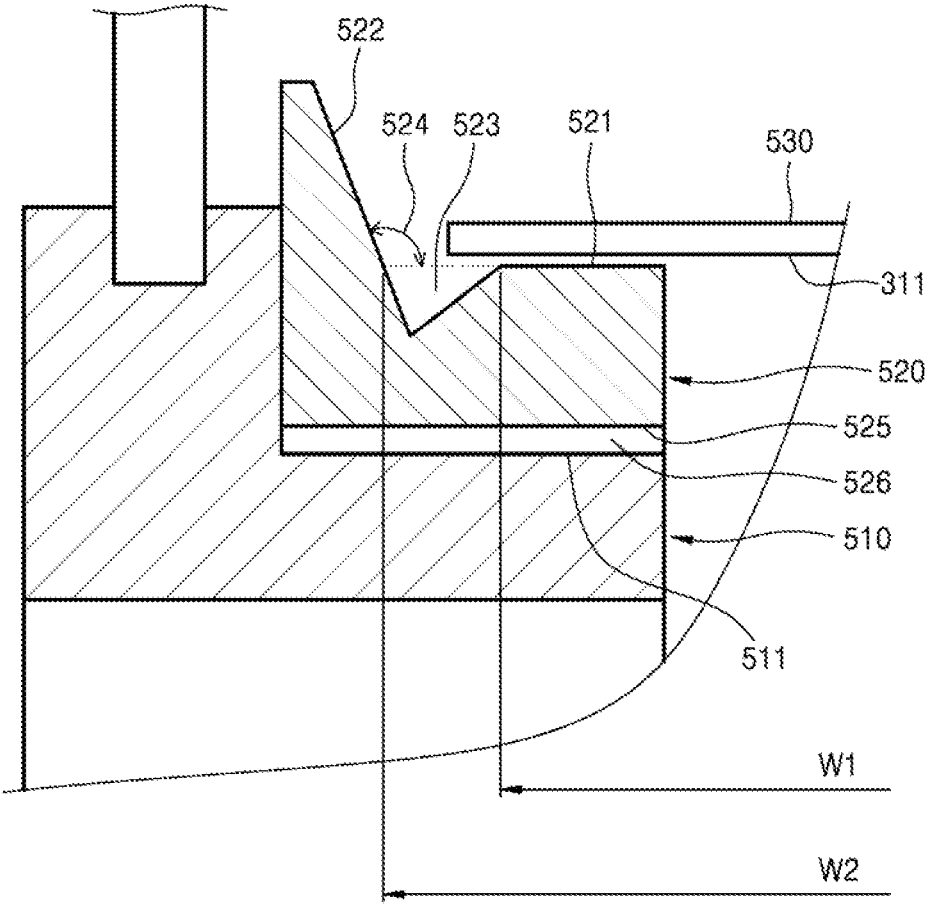
【Figure 6】
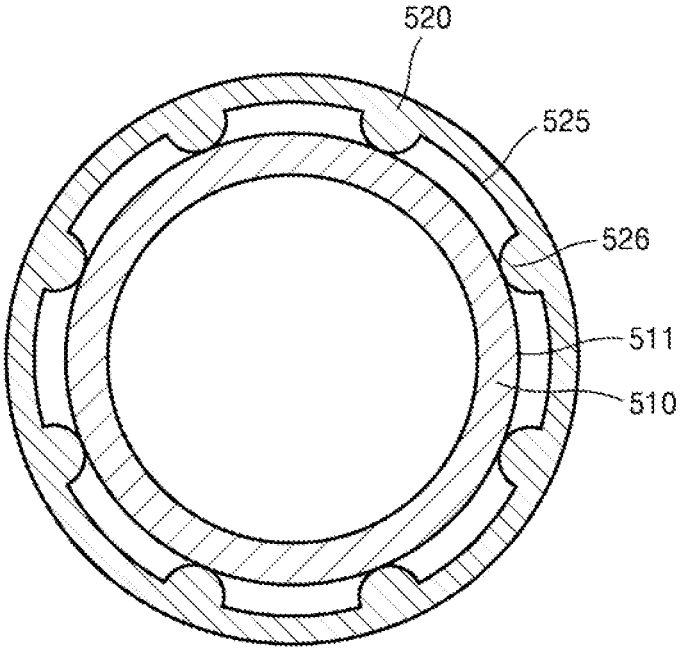

[Figure 7]
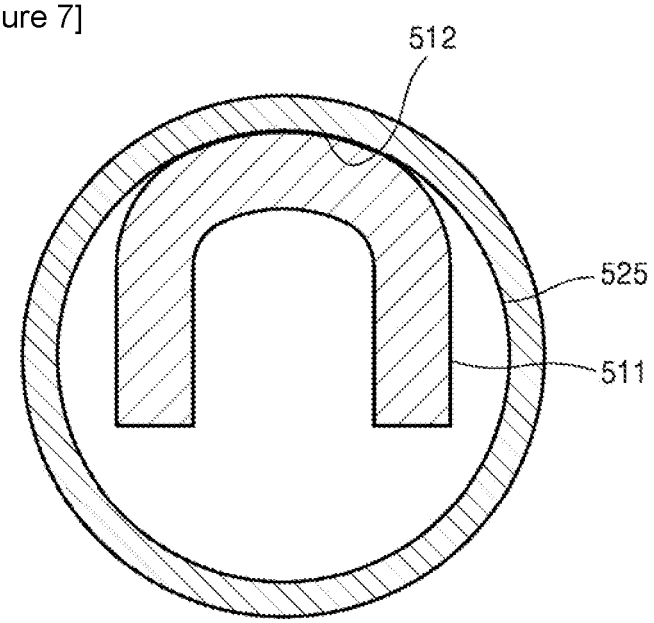

[Figure 8]
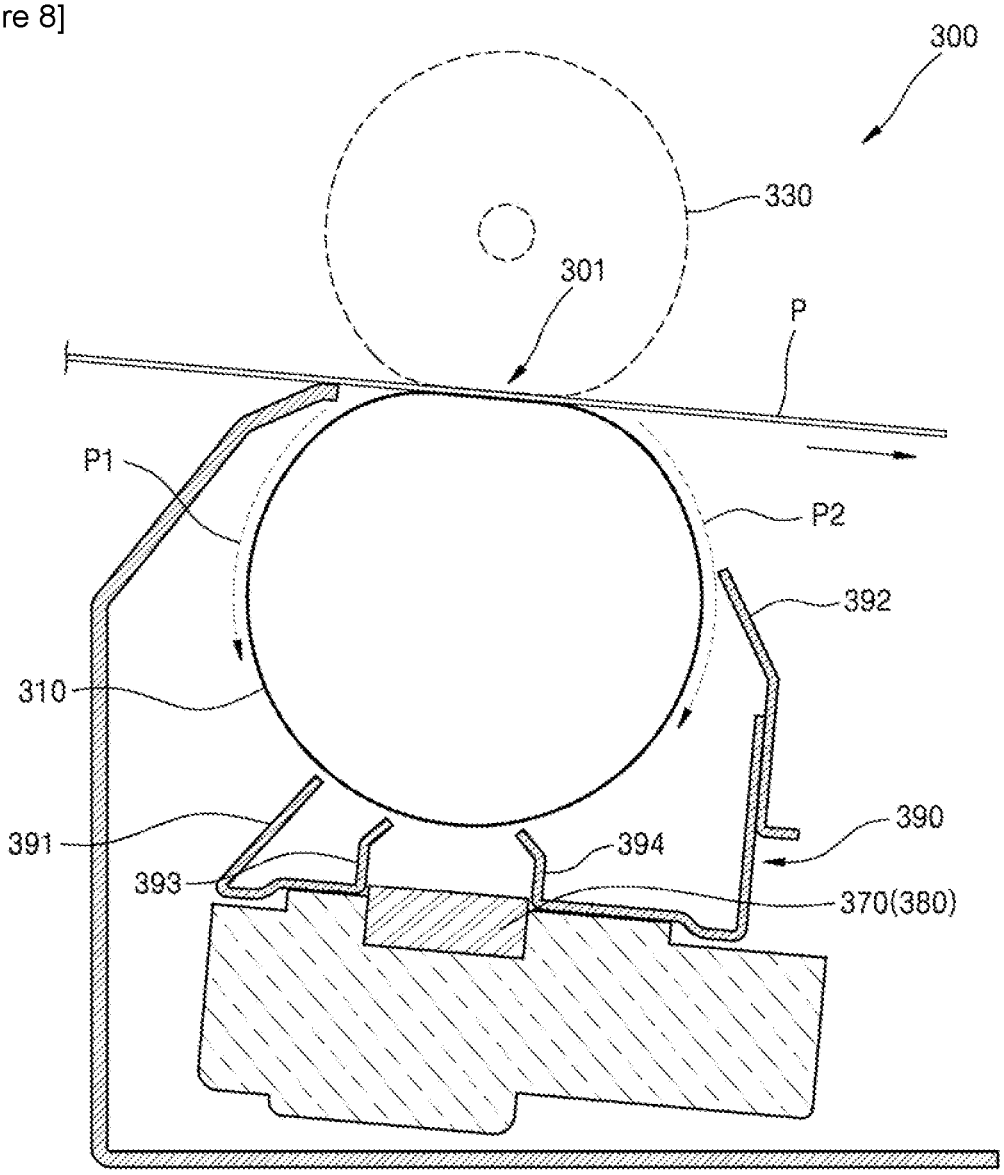

[Figure 9]
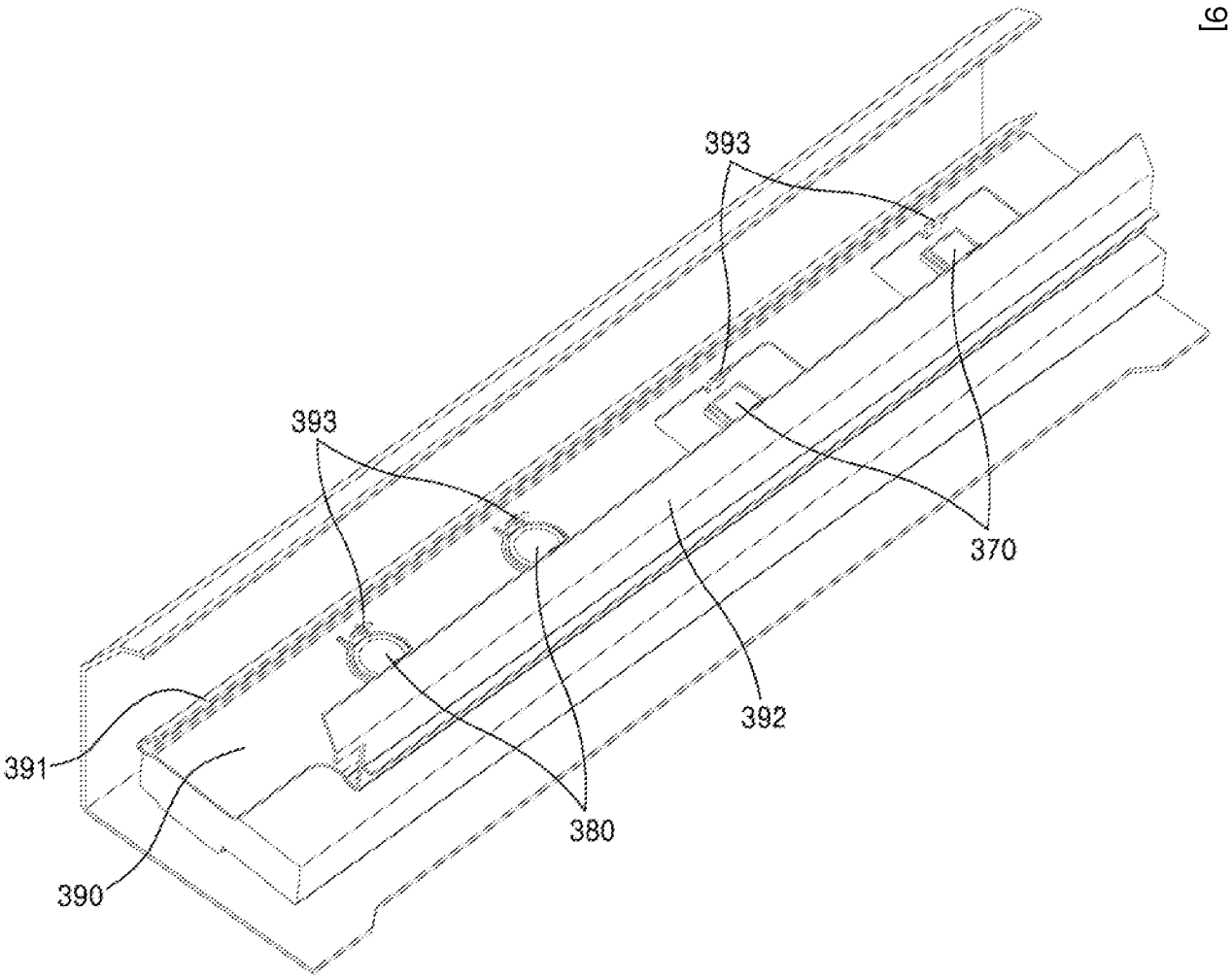

FUSER WITH ENDLESS BELT SUPPORTED BY ROTATIONAL MEMBER

CROSS REFERENCE TO RELATED APPLICATIONS

This application is filed under 35 U.S.C. § 371 as a PCT national phase of PCT International Application No. PCT/KR2018/009630, filed on Aug. 22, 2018, which claims the priority benefit of Korean Patent Application No. 10-2018-0030544, filed on Mar. 15, 2018 in the Korean Intellectual Property Office, the contents of the PCT International Application and the Korean Patent Application are incorporated by reference herein in their entirety.

BACKGROUND ART

A printing medium on which an image is printed receives heat and pressure by passing through a fuser, and the image is fused on the printing medium accordingly. Passing through the fuser, curling of the printing medium may be smoothed out to thereby flatten the printing medium and surface roughness of the printing medium may be reduced.

The fuser may have various structures. For example, the fuser may include a pressing roller and an endless belt that are engaged with each other to form a heating nip. The endless belt is heated using a heat source. The endless belt is rotated by following rotation of the pressing roller. The fuser includes a temperature sensor for temperature control and an overheating prevention sensor.

DESCRIPTION OF DRAWINGS

FIG. 1 is a schematic structural diagram of an inkjet printer according to an example;

FIG. 2 is a schematic cross-sectional view of a fuser according to an example;

FIG. 3 is a cross-sectional view of a guide structure of an endless belt according to an example;

FIG. 4 is a graph showing a rotational linear velocity of a rotational member measured by varying a diameter of an insertion portion of the rotational member;

FIG. 5 is a detailed view of a portion A of FIG. 3;

FIG. 6 illustrates an example of a structure for reducing frictional resistance between a rotational member and a shaft supporting member;

FIG. 7 illustrates an example of a structure for reducing frictional resistance between a rotational member and a shaft supporting member;

FIG. 8 is a schematic cross-sectional view of a fuser according to an example; and FIG. 9 is a perspective view illustrating a temperature sensor and an overheating prevention member.

MODE FOR INVENTION

FIG. 1 is a schematic structural diagram of an inkjet printer according to an example. Referring to FIG. 1, the inkjet printer may include an image forming unit 100 forming an image by ejecting a liquid, for example, ink, onto a printing medium P. The image forming unit 100 may include an inkjet head 110. The inkjet head 110 may include an ink tank accommodating an ink. The ink tank may be separable from the inkjet head 110, and may be connected to the inkjet head 110 via a connection member such as a pipe, to supply an ink to the inkjet head 110.

The inkjet head 110 may be a shuttle-type inkjet head that moves reciprocally in a main scanning direction and ejects an ink to the printing medium P that is moved in a sub-scanning direction. The inkjet head 110 may be an array inkjet head that has a length in a main scanning direction corresponding to a width of the printing medium P. The array inkjet head does not move in the main scanning direction. The array inkjet head ejects an ink to the printing medium P fed in the sub-scanning direction at a fixed position. Compared to when using a shuttle-type inkjet head, high-speed printing may be achieved by using the array inkjet head.

The inkjet head 110 may be a monochrome inkjet head ejecting, for example, black color ink. The inkjet head 110 may be a color inkjet head ejecting, for example, ink of black (K), yellow (Y), magenta (M), and cyan (C) colors.

The printing medium P withdrawn from a paper feeding cassette 130 via a pickup roller 120 is transported by using a transport roller 140 in a sub-scanning direction. The printing medium P is supported by a platen 150 such that a predetermined distance with respect to the inkjet head 110 is maintained. The inkjet head 110 ejects an ink to the printing medium P to print an image. The printing medium P is transported by using a transport roller 160. The ink that is on the printing medium P and has arrived at the transport roller 160 is not yet dried, and thus surface contact between the transport roller 160 and the image of the printing medium P may result in blurring or contamination of the image. The transport roller 160 may have a structure to prevent blurring of images. For example, the transport roller 160 may include a pair of rollers that are engaged with each other, and one of the rollers that is located at an image surface of the printing medium P may be in point-contact with the image surface. The printing medium P is discharged to a discharging tray 170.

When ink is ejected onto the printing medium P, the ink permeates the printing medium P, and curling may occur in the printing medium P. In addition, if moisture that has permeated through the printing medium P is not completely removed, the printing medium P may have a rough surface. This may result in irregular stacking of the printing medium in the discharging tray 170. For example, if the printing medium P has a rough surface or curls, and when a next printing medium P (second medium) is discharged over a previously discharged printing medium P (first medium), the first medium may be pushed by the second medium.

The inkjet printer may further include a finisher 200. In this case, the printing medium P is transported along a discharging path 180 and sent to the finisher 200. The finisher 200 may include an aligning device aligning the printing medium P that is discharged after an image is printed thereon. The aligning device may have a structure of stapling the aligned printing medium P or a structure of perforating the aligned printing medium P. The finisher 200 may also include a paper folding device that folds the printing medium at least one time. Curls or a rough surface of the printing medium P may affect operational reliability of the finisher 200.

The inkjet printer according to an example includes a fuser 300. The fuser 300 planarizes the printing medium P by smoothing out curling of the printing medium P by applying heat and pressure to the printing medium P on which an image is printed, and may at the same time completely remove moisture in the printing medium P to reduce surface roughness of the printing medium P. Accordingly, high speed of the inkjet printer may be achieved, and when the finisher 200 is used, operational reliability of the finisher 200 may be provided.

A length of a transporting path of the printing medium P between the image forming unit 100 and the fuser 300 may be long enough to allow a period of time for the ink ejected onto the printing medium P to dry without spreading.

When a printing speed increases, a time period for the ink on the printing medium P between the image forming unit 100 and the fuser 300 to dry may not be provided. A dryer 400 driving the ink on the printing medium P may be located between the image forming unit 100 and the fuser 300. The dryer 400 is located to face an image surface of the printing medium P that is discharged from the image forming unit 100. The dryer 400 may be a non-contact type dryer that does not contact the printing medium P. The dryer 400 may dry the ink on the printing medium P, for example, by supplying the air to the printing medium P coming out of the inkjet head 110. The dryer 400 may include a fan. The dryer 400 may include a heater heating the air coming from the fan.

Hereinafter, the fuser 300 according to an example will be described.

FIG. 2 is a schematic cross-sectional view of the fuser 300 according to an example. Referring to FIG. 2, the fuser 300 may include an endless belt 310 that rotates, a heat source 320 located within the endless belt 310, and a pressing roller 330 that is outside the endless belt 310, wherein a heating nip 301 through which the printing medium P passes is formed by the pressing roller 330 and the endless belt 310. The endless belt 310 is located opposite an image surface of the printing medium P. The pressing roller 330 is rotated by being pressurized toward the endless belt 310 to thereby drive the endless belt 310. The heat source 320 heats the endless belt 310.

The endless belt 310 may include, for example, a substrate in the form of a film. The substrate may be, for example, a thin metal film such as a stainless steel thin film, a nickel thin film or the like. The substrate may be a polymer film having abrasion resistance and heat resistance to withstand a heating temperature of the fuser 300, for example, at a temperature of about 120° C. to 200° C. For example, the substrate may be formed of a polyimide film, a polyamide film, a polyimideamide film or the like. A thickness of the substrate may be selected such that the endless belt 310 is flexible and resilient enough to flexibly deform at the heating nip 301 and recover to its original state after leaving the heating nip 301. For example, the substrate may have a thickness of about tens to about hundreds of micrometers.

An outermost layer of the endless belt 310 may be a release layer. The release layer may prevent the printing medium P that has left the heating nip 301, from being attached to an external surface of the endless belt 310, but may allow the printing medium P to be separated from the endless belt 310. The release layer may be a resin layer having excellent separability. The release layer may be, for example, one of perfluoroalkoxy (PFA), polytetrafluoroethylenes (PTFE), fluorinated ethylene propylene (FEP) or the like or a blend thereof or a copolymer thereof.

An elastic layer may be interposed between the substrate and the release layer. The elastic layer facilitates formation of a heating nip, and may be formed of a material having thermal resistance to withstand a heating temperature. For example, the elastic layer may be formed of a rubber material such as fluorine rubber, silicone rubber, natural rubber, isoprene rubber, butadiene rubber, nitrile rubber, chloroprene rubber, butyl rubber, acrylic rubber, hydrin rubber, or urethane rubber, or any one of various thermoplastic elastomers such as a styrene type, a polyolefin type, a polyvinyl chloride type, a polyurethane type, a polyester type, a polyamide type, a polybutadiene type, a transpolyisoprene type, and a chlorinated polyethylene type elastomers, a mixture thereof or a composite thereof.

The pressing roller 330 may be in the form of a metallic core, on an outer circumference of which an elastic layer is formed. A backup member 340 may be located inside the endless belt 310 to face the pressing roller 330. An elastic member 350 provides the backup member 340 with an elastic force applied towards the pressing roller 330. For example, the elastic member 350 may include an intermediate member 341 between the elastic member 350 and the backup member 340 to push the backup member 340 towards the pressing roller 330. Accordingly, the backup member 340 is pressurized towards the pressing roller 330 with the endless belt 310 interposed therebetween, and the heating nip 301, through which the printing medium P passes, may be formed between the endless belt 310 and the pressing roller 330. The endless belt 310 may be driven by using the pressing roller 330 whereby the pressing roller 330 is rotated while the pressing roller 330 is pressurized with the endless belt 310 interposed between the pressing roller 330 and the backup member 340.

A thermally conductive plate 360 may also be between the endless belt 310 and the backup member 340. The thermally conductive plate 360 may be a metallic thin film. By including the thermally conductive plate 360 between the endless belt 310 and the backup member 340, a temperature of the heating nip 301 may be maintained uniform. In addition, by including the thermally conductive plate 360 that has a width that is equal to or greater than a width of the heating nip 301, a range of heat transfer to the printing medium P may be extended.

The heat source 320 heats the endless belt 310. The heat source 320 may be located inside the endless belt 310. The heat source 320 may heat the endless belt 310 in a non-contact state. For example, the heat source 320 may be a halogen lamp.

The heat source 320 may be located adjacent to the heating nip 301. For example, as indicated by dotted lines in FIG. 2, a recess 342 may be provided at a position corresponding to the heating nip 301 of the backup member 340, and the heat source 320 may be a ceramic heater located in the recess 342. The ceramic heater has a structure in which a metal heating element pattern layer is placed on an insulating ceramic substrate and an insulating layer is placed on the metal heating element pattern layer. Alumina ($Al_2O_3$), aluminum nitride (AlN) or the like is typically used as a ceramic base substrate, and an Ag—Pd alloy is used as the metal heating element pattern layer. A glass layer is typically used as the insulating layer. An electrode used to supply a current to the metal heating element pattern layer is placed on the ceramic substrate. The electrode is connected to a power supply via, for example, a connector. In this case, by using the thermally conductive plate 360, heat of the heat source 320 may be uniformly transferred to the endless belt 310 in the vicinity of the heating nip 301. In addition, other various types of heat generating units may be used as the heat source 320.

As described above, the endless belt 310 is driven and rotated as the pressing roller 330 is rotated. Hereinafter, a guide structure according to an example, via which the endless belt 310 is guided to stably rotate will be described.

FIG. 3 is a cross-sectional view of a guide structure of the endless belt 310 according to an example. Referring to FIG. 3, a pair of shaft supporting members 510 or a pair of supporting member 510 spaced apart from each other in a length-wise (or axial) direction of the endless belt 310 are illustrated. For example, the fuser 300 may include a pair of side frames 500, and the pair of shaft supporting members 510 may be respectively installed on the pair of side frames 500. The pair of shaft supporting members 510 may be in a single body with the pair of side frames 500 or may be assembled with the pair of side frames 500. A pair of rotational members 520 are respectively rotatably supported by the pair of shaft supporting members 510. The pair of rotational members 520 are inserted into an inner diameter portion 311 of the endless belt 310 from two side end portions such as two axial side end portions of the endless belt 310.

The rotational members 520 may rotate by following the rotation of the endless belt 310. While a method of coupling the rotational members 520 to the two side end portions of the endless belt 310 via interference fit, the endless belt 310 is very thin, about several hundreds of microns, and thus, it is difficult to couple the rotational members 520 to the endless belt 310 via interference fit. There is a risk of damaging the two side end portions of the endless belt 310 during the coupling process through interference fit.

The rotational members 520 according to an example are loosely inserted into the inner diameter portion 311 of the endless belt 310 from the two side end portions of the endless belt 310 in a length-wise (or axial) direction. When the endless belt 310 rotates, the pair of the rotational members 520 are rotated with respect to the pair of shaft supporting members 510 together with the endless belt 310.

The rotational members 520 include an insertion portion 521 inserted into the inner diameter portion 311 of the endless belt 310. The insertion portion 521 may be cylindrical. The insertion portion 521 contacts the inner diameter portion 311 of the endless belt 310 to support the inner diameter portion 311. When the endless belt 310 rotates, the rotational members 520 may rotate together with the endless belt 310 due to friction between the inner diameter portion 311 and the insertion portion 521.

If slipping occurs between the rotational members 520 and the endless belt 310, stress is applied to the endless belt 310, increasing the risk of damage to the endless belt 310. At least in an initial driving stage where a large amount of stress is applied to the endless belt 310, the rotational members 520 are to be rotated by following the rotation of the endless belt 310. To this end, a diameter of the insertion portion 521 may be equal to or greater than at least about 90% of a diameter of the inner diameter portion 311 of the endless belt 310. The rotational members 520 are to be stably rotated according to rotation of the endless belt 310. To this end, a diameter of the insertion portion 521 may be equal to or greater than about 95% of the diameter of the inner diameter portion 311 of the endless belt 310.

A rotational linear velocity of the endless belt 310 depends on a rotational linear velocity of the pressing roller 330. Whether the rotational members 520 stably follow rotation of the endless belt 310 may be confirmed by comparing a rotational linear velocity of the rotational members 520 with that of the pressing roller 330. FIG. 4 is a graph showing rotational linear velocity of the rotational members 520 measured by varying a diameter of the insertion portion 521 of the rotational members 520. A rotational linear velocity of the rotational members 520 was measured by setting a diameter of the supporting portion 511 of the endless belt 310 to 35 mm and a diameter of the insertion portion 521 of the rotational members 520 to 31 mm, 33 mm, and 34 mm, respectively. In FIG. 4, a horizontal axis denotes time, and a vertical axis denotes a rotational linear velocity. C1, C2, and C3 denote each a rotational linear velocity of the rotational member 520 when a diameter of the insertion portion 521 is 31 mm, 33 mm, and 34 mm, respectively. C4 denotes a rotational linear velocity of the pressing roller 330. In FIG. 4, the rotational linear velocity of the pressing roller 330 was 8.47 rad/sec (radian/second).

Referring to FIG. 4, in C1, a diameter of the insertion portion 521 is about 88.5% (less than 90%) of a diameter of the inner diameter portion 311. This shows that it is difficult for the rotational members 520 to follow the rotation of the endless belt 310. That is, slipping continuously occurs between the rotational members 520 and the endless belt 310 such that the rotational members 520 hardly rotate. In this case, stress may be applied to the endless belt 310, and when used for a longer period, stress may be accumulated and cause damage to the endless belt 310.

In C2, a diameter of the insertion portion 521 is about 94% of a diameter of the inner diameter portion 311, more than 90%. In an initial driving stage where a large amount of stress may be applied to the endless belt 310, the rotational members 520 are rotated by following the rotation of the endless belt 310. Next, slipping occurs intermittently between the rotational members 520 and the endless belt 310. Thus, the stress applied to the endless belt 310 may be reduced, and so is the risk of damage.

In C3, a diameter of the insertion portion 521 is about 97% of a diameter of the inner diameter portion 311, more than 95%. The rotational members 520 are stably rotated by following the rotation of the endless belt 310 even from an initial driving stage. Thus, the stress and risk of damage to the endless belt 310 may be reduced even more.

FIG. 5 is a detailed view of a portion A of FIG. 3. Referring to FIG. 5, the rotational members 520 may further include a regulator 522 extending from the insertion portion 521 to regulate lengthwise movement of the endless belt 310. The risk of damage to the endless belt 310 is likely to occur at two side end portions thereof. If the two side end portions of the endless belt 310 are damaged, this damage may be extended according to long-time rotation of the endless belt 310 and lead to overall damage to the endless belt 310. Damage to the two side end portions of the endless belt 310 may be caused by contact between the endless belt 310 and the rotational members 520. The possibility of contact between the two side end portions of the endless belt 310 and the rotational members 520 may be reduced to reduce the risk of damage to the two side end portions of the endless belt 310. To this end, a recessed portion 523 recessed from the insertion portion 521 may be provided between the insertion portion 521 and the regulator 522.

An inner width W2 of the regulators 522 of the pair of rotational members 520 is slightly greater than a length of the endless belt 310. An inner width W1 of the recessed portions 523 of the pair of rotational members 520 is slightly smaller than the length of the endless belt 310. According to this structure, the two side end portions of the endless belt 310 are set to be located in the recessed portions 523 such that the two side end portions of the endless belt 310 do not contact the insertion portion 521 and the regulators 522. In addition, by setting an angle 524 between the insertion portion 521 and the regulators 522 to be an obtuse angle, the possibility of contact between the two side end portions of the endless belt 310 and the regulators 522 may be reduced. Accordingly, the risk of damage to the endless belt 310 due to contact between the rotational members 520 and the endless belt 310 may be reduced.

In order for the rotational members 520 to stably rotate with respect to the shaft supporting members 510, a method of reducing frictional resistance between the rotational members 520 and the shaft supporting members 510 may be considered. For example, a contact surface between the rotational members 520 and the shaft supporting members 510 may be reduced. Referring to FIG. 5, the rotational members 520 may include a hollow portion 525 that is concentric to the insertion portion 521. The shaft supporting members 510 include a supporting portion 511. The hollow portion 525 may be inserted into the supporting portion 511 to be rotatably supported.

At least one of the hollow portion 525 and the supporting portion 511 may be entirely cylindrical. In this case, in order to reduce frictional resistance, a plurality of protrusions may be provided on one of the hollow portion 525 and the supporting portion 511. The plurality of protrusions protrudes from one of the hollow portion 525 and the supporting portion 511 and may extend in a length-wise (or axial) direction. The plurality of protrusions may be arranged in a circumferential direction. FIG. 6 illustrates an example of a structure for reducing frictional resistance between the rotational members 520 and the shaft supporting members 510. Referring to FIGS. 5 and 6, a plurality of protrusions 526 protruding inwards are formed on the hollow portion 525. The plurality of protrusions 526 may also extend in a length-wise (or axial) direction. For example, although not illustrated in the drawings, the plurality of protrusions 526 may be provided on the supporting portion 511. According to this structure, frictional resistance between the rotational members 520 and the shaft supporting members 510 may be reduced such that the rotational members 520 stably rotate.

As another example, the hollow portion 525 may be entirely cylindrical, and the supporting portion 511 may be partially cylindrical. FIG. 7 illustrates an example of a structure for reducing frictional resistance between the rotational members 520 and the shaft supporting members 510. Referring to FIG. 7, the hollow portion 525 is entirely cylindrical. The supporting portion 511 is partially cylindrical. That is, the supporting portion 511 may include a partial cylindrical portion 512. One or two partial cylindrical portions 512 may be included. When one partial cylindrical portion 512 is included, the partial cylindrical portion 512 may be located to face the pressing roller 330.

When wrap jam that the printing medium P is wound around the endless belt 310 occurs, the endless belt 310 may be damaged when removing the wrap jam. In addition, the wrap jam may also affect temperature control of the fuser 300 and prevention of overheating of the fuser 300.

FIG. 8 is a schematic cross-sectional view of the fuser 300 according to an example. The heat source 320 and the backup member 340 located inside the endless belt 310 are omitted in FIG. 8. FIG. 9 is a perspective view illustrating a temperature sensor 370 and an overheating prevention member 380.

Referring to FIGS. 8 and 9, the fuser 300 may include the temperature sensor 370 sensing a temperature of the endless belt 310. A controller (not shown) may control the heat source 320 such that the endless belt 310 is maintained at an appropriate heating temperature based on a temperature sensed using the temperature sensor 370. The fuser 300 may include the overheating prevention member 380. The overheating prevention member 380 blocks power supply to the heat source 320 when a temperature of the endless belt 310 exceeds a predetermined or set temperature. The overheating prevention member 380 may include, for example, a thermostat. The temperature sensor 370 and the overheating prevention member 380 may be installed, for example, on a supporting member 390. The temperature sensor 370 and the overheating prevention member 380 may be installed on the supporting member 390 such that they are exposed to the endless belt 310.

A curled or folded front end of the printing medium P may prevent the printing medium P from being stably introduced into the heating nip 301 and cause the printing medium P to be bent towards the endless belt 310 as indicated by P1 and wound by the heating nip 301. In addition, after the printing medium P has passed through the heating nip 301, the printing medium P may not be stably separated from the endless belt 310 but be wound by the endless belt 310 as indicated by P2. If such wrap jam occurs, the endless belt 310 may be damaged when removing the wrap jam.

When the printing medium P is interposed between the endless belt 310 and the temperature sensor 370, an error may occur in sensing a temperature of the endless belt 310. For example, a temperature of the endless belt 310 lower than an actual temperature may be measured, and when the heat source 320 is controlled based on the incorrect temperature, the temperature of the endless belt 310 may be higher than an appropriate heating temperature.

In addition, when the printing medium P is interposed between the endless belt 310 and the overheating prevention member 380, even when the endless belt 310 is overheated, the overheating prevention member 380 may not sense the overheating of the endless belt 310.

A first winding prevention member that blocks the printing medium P from entering between the temperature sensor 370 and the overheating prevention member 380 and the endless belt 310 (e.g., in between the temperature sensor 370 and the endless belt 310 and/or in between the overheating prevention member 380 and the endless belt 310) may be installed between at least one of an entry and an exit of the heating nip 301 and the temperature sensor 370 and the overheating prevention member 380 (e.g., in between the entry of the heating nip and the temperature sensor, in between the entry of the heating nip and the overheating prevention member, in between the exit of the heating nip and the temperature sensor, and/or in between the exit of the heating nip and the overheating prevention member). According to an example, first winding prevention members 391 and 392 are respectively installed at the entry and the exit of the heating nip 301. A distance between ends of the first winding prevention members 391 and 392 and the endless belt 310 may be within about 2 mm. According to this configuration, even when jam occurs, in which the printing medium P is wound around the outer circumference of the endless belt 310 through a path denoted by reference signs P1 or P2, the printing medium P is not able to enter where the temperature sensor 370 and the overheating prevention member 380 are installed, and thus overheating of the endless belt 310 may be prevented. When a single first winding prevention member is installed, the first winding prevention member 392 may be installed at the exit of the heating nip 301.

A second winding prevention member that blocks the printing medium P from entering between the temperature sensor 370 and the overheating prevention member 380 and the endless belt 380 (e.g., in between the temperature sensor and the endless belt, and in between the overheating prevention member and the endless belt) may be installed between the first winding prevention members and the temperature sensor 370 and the overheating prevention member 380 (e.g., in between the first winding prevention member and the temperature sensor, and/or in between the first winding prevention member and the overheating prevention member). The second winding prevention member may be located adjacent to the temperature sensor 370 and the overheating prevention member 380. The second winding prevention member blocks one more time the printing medium P that has passed through the first winding prevention members. Accordingly, reliability regarding overheating prevention of the fuser 300 may be increased. According to an example, second winding prevention members 393 and 394 are arranged at both sides of the temperature sensor 370 and the overheating prevention member 380. A distance between ends of the second winding prevention members 393 and 394 and the endless belt 310 may be within about 2 mm. When a single second winding prevention member is installed, the second winding prevention member 394 may be installed at the exit of the heating nip 301.

Referring to FIG. 1 again, an entry roller 180 may be arranged at an entry of the fuser 300. The entry roller 180 transports the printing medium P on which an image is printed, to the heating nip 301 of the fuser 300. The entry roller 180 may include, for example, a pair of rollers that are rotated by being engaged with each other such that the printing medium P is transported between the pair of rollers. As described above, to prevent contamination or blurring of the image printed on the printing medium P, a length of a transport path of the printing medium P between the image forming unit 100 and the fuser 300 may be set such that a sufficient period of time is provided such that ink ejected onto the printing medium P is not to spread due to contact with the entry roller 180. When a dryer 400 is used, a drying capacity of the dryer 400 may be set such that the ink ejected onto the printing medium P does not spread due to contact with the entry roller 180.

At least one discharging roller 190 transporting the printing medium P discharged from the heating nip 301 may be arranged at an exit of the fuser 300. The at least one discharging roller 190 may include a pair of rollers that are rotated by being engaged with each other such that the printing medium P is transported between the pair of rollers. A rotational linear velocity of the at least one discharging roller 190 may be higher than a rotational linear velocity of the pressing roller 330. According to this configuration, tension acts upon the printing medium P between the fuser 300 and the discharging roller 190, and accordingly, curling of the printing medium P may be smoothed out more easily. In order to prevent slipping of the printing medium P between the endless belt 310 and the pressing roller 330, a pressing force between a pair of rollers of the discharging roller 190 is less than a pressing force between the endless belt 310 and the pressing roller 330.

The discharging roller 190 according to an example includes first and second discharging rollers 191 and 192 that are sequentially arranged from the exit of the heating nip 301. Rotational linear velocity of the first and second discharging rollers 191 and 192 are higher than a rotational linear velocity of the pressing roller 330. A rotational linear velocity of the second discharging roller 192 is equal to or higher than that of the first discharging roller 191.

While examples have been described with reference to the figures, it will be understood by those of ordinary skill in the art that various changes in form and details may be made therein without departing from the spirit and scope as defined by the following claims.

The invention claimed is:

1. A fuser to be coupled to an inkjet printer, the fuser comprising:

an endless belt;

a heat source to heat the endless belt;

a pressing roller to press the endless belt to form a heating nip, through which a printing medium is to pass, the pressing roller to rotate the endless belt;

a pair of supporting members spaced apart from each other in an axial direction of the endless belt; and a pair of rotational members, each rotational member of the pair of rotational members includes, an insertion portion inserted into an inner diameter portion of the endless belt, respectively at two side end portions of the endless belt, and a regulator portion extending from the insertion portion at an obtuse angle with the insertion portion, to form a recessed portion between the insertion portion and the regulator portion, the pair of rotational members to be rotatably supported by the pair of supporting members and rotated with the endless belt.

2. The fuser of claim 1, wherein each rotational member of the pair of rotational members includes a cylindrical insertion portion to be inserted into the inner diameter portion of the endless belt, wherein a diameter of the insertion portion is equal to or greater than 90% of a diameter of the inner diameter portion.

3. The fuser of claim 2, wherein a diameter of the insertion portion is equal to or greater than 95% of a diameter of the inner diameter portion.

4. The fuser of claim 1, wherein the regulator is to regulate movement of the endless belt in the axial direction.

5. The fuser of claim 4, wherein each rotational member of the pair of rotational members includes a hollow portion concentric to the insertion portion, each supporting member of the supporting members includes a supporting portion, by which the hollow portion is rotatably supported, and the hollow portion or the supporting portion includes a plurality of protrusions extending in the axial direction, the plurality of protrusions arranged in a circumferential direction of the endless belt.

6. The fuser of claim 1, comprising:

a temperature sensor to sense a temperature of the endless belt; and an overheating prevention member to block power supply to the heat source when the temperature sensor senses the temperature exceeding a set temperature value, a first winding prevention member to block the printing medium from entering in between the temperature sensor and the endless belt, and/or in between the overheating prevention member and the endless belt, the first winding prevention member disposed in between an entry of the heating nip and the temperature sensor, in between the entry of the heating nip and the overheating prevention member, in between an exit of the heating nip and the temperature sensor, and/or in between the exit of the heating nip and the overheating prevention member.

7. The fuser of claim 6, comprising:

a second winding prevention member to block the printing medium from entering in between the temperature sensor and the endless belt, and in between the overheating prevention member and the endless belt, the second winding prevention member disposed in between the first winding prevention member and the temperature sensor, and/or in between the first winding prevention member and the overheating prevention member.

8. An inkjet printer comprising:

an image former to eject a liquid onto a printing medium to form an image; and the fuser according to claim 1, to heat the printing medium that has passed through the image former.

9. The inkjet printer of claim 8, comprising at least one discharging roller that is disposed at an exit of the heating nip, the at least one discharging roller to transport the printing medium passed through the heating nip, wherein a rotational linear velocity of the at least one discharging roller is higher than a rotational linear velocity of the pressing roller.

10. The inkjet printer of claim 9, wherein the at least one discharging roller includes a first discharging roller and a second discharging roller that are sequentially arranged from the exit of the heating nip.

11. The inkjet printer of claim 10, wherein a rotational linear velocity of the second discharging roller is equal to or higher than a rotational linear velocity of the first discharging roller.

12. The inkjet printer of claim 9, wherein the at least one discharging roller includes a pair of rollers that are rotated by being engaged with each other, wherein a pressing force acting between the pair of rollers is less than a pressing force between the endless belt and the pressing roller.

13. The inkjet printer of claim 9, comprising a dryer that is located between the image former and the fuser, the dryer to dry the liquid on the printing medium.

14. The inkjet printer of claim 8, wherein the image former includes an array inkjet head to eject the liquid onto the printing medium at a fixed location.

* * * * *